United States Patent [19]

Hayashi

[11] Patent Number: 4,483,167

[45] Date of Patent: Nov. 20, 1984

[54] FORMING ROLLS FOR USE IN THE FABRICATION OF WELDED TUBES

[75] Inventor: Masayuki Hayashi, Toda, Japan

[73] Assignee: Kabushiki Kaisha Sanyo Seiki, Saitama, Japan

[21] Appl. No.: 342,702

[22] Filed: Jan. 25, 1982

[30] Foreign Application Priority Data

Jul. 14, 1981 [JP] Japan ..... 56-104442

[51] Int. Cl.[3] ..... B21D 5/14; B21B 27/02; B21H 8/02

[52] U.S. Cl. ..... 72/179; 72/182; 72/52; 228/147

[58] Field of Search ..... 72/178–182, 72/176, 51, 52; 228/147, 146

[56] References Cited

U.S. PATENT DOCUMENTS

| | | | |
|---|---|---|---|
| 12,268 | 1/1855 | Booth | 72/178 |
| 726,691 | 4/1903 | Johnson | 72/180 |
| 845,437 | 2/1907 | Schmeltzer | 72/180 |
| 1,510,704 | 10/1924 | Rendleman | 72/180 |
| 1,936,228 | 11/1933 | Crafton | 72/180 |
| 2,343,126 | 2/1944 | Matlat | 72/180 |
| 3,344,641 | 10/1967 | Pomory | 72/180 |
| 4,030,330 | 6/1977 | Nyssen et al. | 72/179 |

FOREIGN PATENT DOCUMENTS

| | | | |
|---|---|---|---|
| 1162282 | 9/1958 | France | 72/179 |
| 898143 | 6/1962 | United Kingdom | 72/180 |

*Primary Examiner*—Daniel C. Crane

*Attorney, Agent, or Firm*—Wenderoth, Lind & Ponack

[57] ABSTRACT

A complementary pair of top and bottom rolls for the initial breakdown step of a skelp in the manufacture of welded tubular products by rolling. The bottom roll has a convex midportion, a pair of concave end portions, and a pair of straight border portions each lying between the midportion and one of the concave end portions. The top roll is shaped in complementary relation to the bottom roll to define therebetween a path for the skelp. The breakdown roll pair of the above configuration makes it possible to curl the opposite edge portions of the skelp into arcs of a desired radius without the usual defects of rolling, and in such a way that the skelp can be subsequently rounded and have its edges welded together into a tube of minimal out-of-roundness.

2 Claims, 9 Drawing Figures

FORMING ROLLS FOR USE IN THE FABRICATION OF WELDED TUBES

CROSS REFERENCE TO RELATED APPLICATION

This application is related to U.S. patent application Ser. No. 342,703 filed on the same date as the present application.

BACKGROUND OF THE INVENTION

1. Field of the Invention

This invention relates generally to the art of metal rolling, and more specifically to forming rolls for processing a strip of metal, generally referred to as the skelp, into welded tubes. Still more specifically, the invention deals with a cooperative pair of top and bottom rolls in a rolling mill for the initial breakdown step of the skelp.

2. Description of the Prior Art

The manufacture of welded tubes or pipes by rolling, which represents a major field of tube production today, is made possible by a variety of methods such as those known as edge forming, center forming, and circular forming. According to a well known train of shaping rolls adopted in such tube fabrication, a skelp is fed successively through a breakdown pass, fin pass, welding pass, and sizing pass. Another known roll train is such that the skelp travels through a succession of breakdown pass, cluster rolls, fin pass, welding pass, and sizing pass.

The breakdown pass has heretofore been defined by a concave bottom roll and a convex top roll (shown in FIG. 1 of the drawings attached hereto) for rolling the skelp into generally arcuate cross sectional shape. This conventional type of breakdown roll has difficulty in curling the opposite longitudinal edge portions of the skelp into arcs of a desired radius. The contours of the breakdown rolls are such that they fail to exert sufficient compressive forces on the edge portions of the skelp. Accordingly, after passing the breakdown rolls, the skelp tends to spring back. This makes it necessary for the subsequent fin pass rolls to apply greater forces to the work than would be required if it were not for such springback, with the consequent likelihood of ruining the rolls or the fins. The springback of the skelp edges also makes difficult the welding of the edges and, at the sizing pass, the processing of the welded tubing into exactly circular cross sectional shape.

An additional drawback of the conventional pair of breakdown rolls is the high possibility of the skelp developing wavy edges, particularly if it is thin. Moreover, in the concave bottom roll of the prior art breakdown roll pair, the roll surface rises steeply as it extends from the midpoint of the roll, where it is of minimum diameter, toward its opposite axial ends. Thus, a considerable difference exists between the peripheral speeds of the center and the end portions of the concave roll. The resulting slip of the roll end portions over the skelp often produces the so-called roll marks thereon.

SUMMARY OF THE INVENTION

It is an object of this invention to provide forming rolls which are not accompanied by all the noted problems and make it possible, as an initial step in the fabrication of welded tubing by rolling, to curl the opposite longitudinal edge portions of a skelp without the defects arising from the use of the conventional forming rolls.

Stated in brief, the invention provides an improved breakdown forming roll set for the above purpose, comprising a first roll having a convex midportion and a pair of concave end portions on opposite sides of the midportion. Also included is a second roll shaped in complementary relation to the first roll, that is, having a concave midportion and a pair of convex end portions. The first and second rolls are arranged with their axes parallel to each other to define therebetween a pass for a skelp to be processed into a welded tube.

The first roll is normally used as the bottom roll, and the second roll as the top roll. The dual concave bottom roll and the dual convex top roll, so to say, in accordance with this invention offer several advantages over the prior art. One is that the opposite end portions of the improved breakdown rolls, where the edge portions of the skelp are curled, can be made wider than those of the conventional simple convex and concave rolls, with respect to a given axial dimension of the rolls. This advantage is realized, moreover, without any such steep rise of the bottom roll surface toward the axial ends of the roll as has been the case with the prior art.

Thus contoured to exert sufficient compressive forces on the edge portions of the skelp, the improved pair of forming rolls effectively curls the skelp edge portions with a drastically reduced possibility of springback, and without development of wavy edges even if the skelp is thin. The creation of roll marks on the skelp is also practically eliminated. Such positive, accurate curling of the skelp edge portions in accordance with the invention makes it easy to subsequently roll the skelp into a tubular shape and to weld its edges together, resulting in the provision of tubing of minimal out-of-roundness.

Additionally, since the breakdown forming roll pair of this invention is well calculated as aforesaid to make utmost use of the applied compressive forces for curling the skelp edge portions, the rolls can be made lighter in weight than the known ones for rolling a skelp of given physical characteristics. Thus, for all their advantages, the inventive breakdown rolls are less expensive than their conventional counterparts.

The above and other features and advantages of this invention and the manner of attaining them will become more clearly apparent, and the invention itself will best be understood, from a study of the following detailed description and appended claims taken together with the attached drawings.

DETAILED DESCRIPTION OF THE PREFERRED EMBODIMENTS

Figure 1:
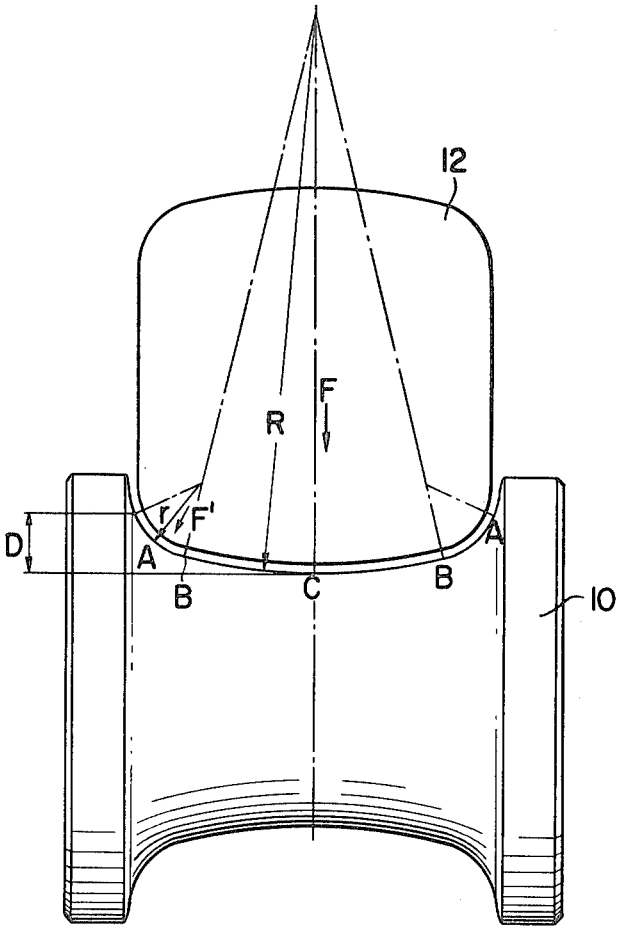
FIG. 1 PRIOR ART
FIG. 1 is a side elevation of the conventional pair of breakdown rolls used in the manufacture of welded tubes.

It is considered essential that, prior to the detailed disclosure of this invention, the aforementioned conventional pair of breakdown rolls be shown and described in some more detail, in order to make clear the features and advantages of the instant invention. FIG. 1 shows the concave bottom roll 10 and convex top roll 12 heretofore used for curling the opposite longitudinal edge portions of a skelp, not shown in this figure, in processing such skelp into welded tubing.

Take, for example, the concave bottom roll 10 to consider the problems of the prior art. The working surface of this bottom roll 10 is composed of a pair of end portions AB each arched with a radius r, and a center portion BCB arched with a radius R. Each end portion AB of the roll 10 is arched with a radius much less than that of the center portion BCB and coacts with the corresponding portion of the convex top roll 12 respectively to curl the edge portions of the skelp. In order to make the bottom roll end portions AB as wide as possible and hence to curl the correspondingly wide edge portions of the skelp, it becomes necessary for the end portions AB to rise steeply toward the opposite axial ends of the roll 10. Thus, a considerable distance D exists between the lowest point in the middle of the center portion BCB and the highest point at the outer end of each end portion AB, as measured in a radial direction of the roll 10.

In rolling the skelp between the two breakdown rolls 10 and 12, the top roll 12 is forced down toward the bottom roll 10 in a direction normal to the roll axes, as indicated by the arrow F in FIG. 1. For curling the edge portions of the skelp, however, the end portions of the AB of the rolls 10 and 12 require forces F′ at considerable angles to the direction of the force F. The components F′ of the force F are usually insufficient to curl the edge portions of the skelp against any possibility of springback and of the development of wavy edges. An additional disadvantage is the substantial difference between the peripheral speeds of the end portions AB and center portion BCB of the bottom roll 10. As has been mentioned, this results in the creation of roll marks on the skelp.

Figure 2:
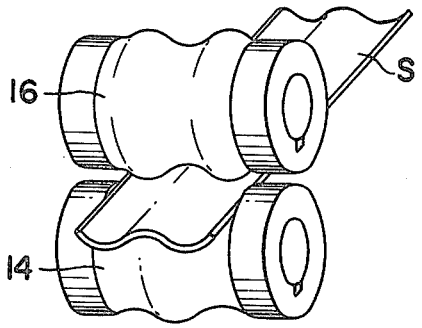
FIG. 2 is a perspective view of the improved pair of breakdown forming rolls constructed in accordance with the principles of the invention, shown together with a skelp being rolled thereby.

The present invention provides a solution to all such problems of the prior art. As illustrated in perspective in FIG. 2, the invention resides in the improved breakdown roll set comprising a dual concave bottom roll 14 and a dual convex top roll 16. The two breakdown rolls 14 and 16 have their axes oriented parallel to each other and are slightly spaced from each other to define an undulatory path therebetween. Traversing this path, a skelp S is bent into the corresponding cross sectional shape, as shown, such that its opposite longitudinal edge portions are curled to expedite the subsequent steps of rolling into a tubular shape, as will be later explained in more detail with reference to FIGS. 6A–6D.

Figure 3:
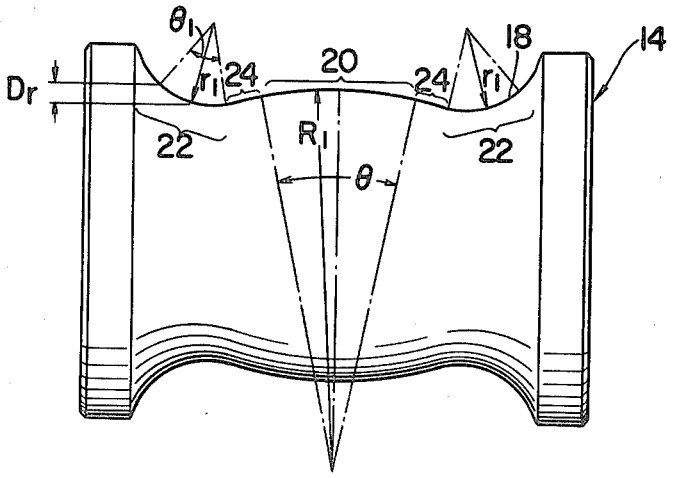
FIG. 3 is an enlarged side elevation of the bottom one of the improved pair of forming rolls of FIG. 2.

FIG. 3 shows the dual concave bottom roll 14 on an enlarged scale to clearly reveal its structural features. The working surface 18 of this bottom roll 14 is composed of a convex midportion 20, a pair of concave end portions 22 on opposite sides of the midportion, and a pair of uncurved or straight border portions 24 each interposed between the convex midportion and one of the concave end portions. The border portions 24, however, constitute no essential feature of this invention taken in its broadest aspect. Nevertheless, this feature is essential to the invention in its more narrow aspects.

The convex midportion 20 of the bottom roll 14 is arched through an angle $\theta$ and with a radius $R_1$. In the illustrated embodiment including the pair of straight border portions 24, the angle $\theta$ ranges from about 16° to about 40°. The surface length of the convex midportion 20 occupies from about 38% to 52% of the length of the working surface 18 of the bottom roll 14, as measured in a direction parallel to the axis of the roll 14. If the angle $\theta$ is less than about 16°, the midportion 20 would become nearly straight, its transverse surface length being definitely proportioned in relation to that of the entire working surface 18. Then, it would become impossible to reduce the rise $D_r$ of the concave end portions 22, which should be kept at a minimum for the reasons already set forth. If the angle $\theta$ were more than about 40°, on the other hand, then the midportion 20 would bulge out inordinately, again its transverse surface length being definitely proportioned in relation to that of the working surface 18. Such excessive bulging of the midportion 20 is objectionable because the resulting upward bulging of the center portion of the skelp S would make difficult the subsequent rolling of the skelp S into a tubular shape, giving rise to the possibility of the skelp S being damaged while being so rolled.

The pair of concave end portions 22 of the bottom roll 14 are each arched through an angle $\theta_1$ and with a radius $r_1$, less than the radius $R_1$ of arc of the convex midportion 20. The combined surface length of these concave end portions 22 occupies from about 40% to about 45% of the length of the working surface 18 of the bottom roll 14, as measured in a direction parallel to the roll axis. The combined surface length of the straight border portions 24 is from about 8% to about 17% of the length of the working surface 18, also as measured in a direction parallel to the roll axis. The convex midportion 20, the pair of concave end portions 22 and the pair of straight border portions 24 form a continuous surface, making up the dual concave contours of the working surface 18.

Such being the construction of the bottom breakdown roll 14, it will be seen that its concave end portions 22 can be made wider than those of the prior art roll 10 of FIG. 1, with respect to a given axial dimension of the roll 14, without causing any steep rise of the end portions 22 toward the axial ends of the roll 14. Further, the interposition of the straight border portions 24 between convex midportion 20 and concave end portions 22 serves to prevent the imprinting of roll marks or rubbed marks on the skelp S owing to the smooth change of the working surface 18. Other advantages accruing from these features of the improved bottom breakdown roll 14 will be apparent from the foregoing description of the invention and of the prior art.

Figure 4:
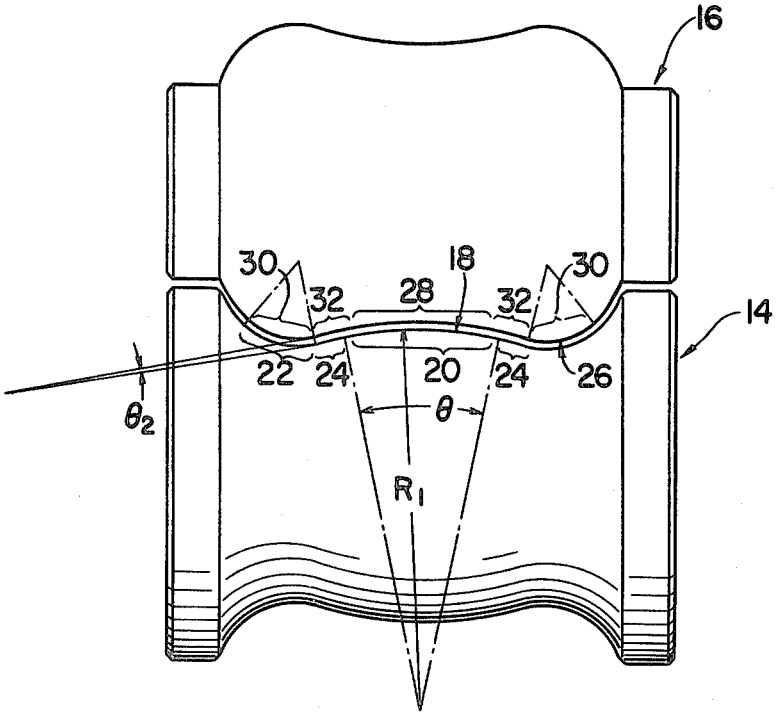
FIG. 4 is an enlarged side elevation of the improved breakdown roll pair of FIG. 2.

In FIG. 4, there is shown the dual convex top roll 16 together with the dual concave bottom roll 14 in their relative working positions. The top roll 16 is shaped in complementary relation to the bottom roll 14, having a working surface 26 composed of a concave midportion 28, a pair of convex end portions 30 on opposite sides of the midportion 28, and a pair of straight border portions 32 each interposed between the concave midportion 28 and one of the convex end portions 30. Thus,the working surfaces 18 and 26 of the two breakdown rolls 14 and 16 are substantially parallel to each other along their lines of contact with the skelps. The modifier "substantially" is used because the opposed lines of the two working surfaces 18 and 26 are intentionally made not exactly parallel to each other in accordance with an additional feature of the invention. The nonparallel relation arises as the spacing between each opposed pair of straight border portions 24 and 32 becomes progressively greater toward the midportions 20 and 28 of the rolls 14 and 16, respectively. For the best results, the angle $\theta_2$ between each opposed pair of border portions, along their divergent lines of contact with the skelps, is from about 0.2° to about 3.0°, preferably from 0.5° to 1.5°.

Naturally, therefore, the spacings between the two opposed pairs of end portions 22 and 30 of the breakdown rolls 14 and 16 are slightly less than the spacing between the opposed pair of midportions 20 and 28. This means that, for a given downward force of the top roll 16, greater compressive forces are exerted on the longitudinal edge portions of the skelps by the two opposed pairs of roll end portions 22 and 30. Stated conversely, less compressive forces need be applied to the rolls 14 and 16 for curling the skelp edges. This advantage, combined with those previously pointed out, makes it possible to reduce the diameters of the breakdown rolls 14 and 16 and to make them lighter in weight.

Figure 5:
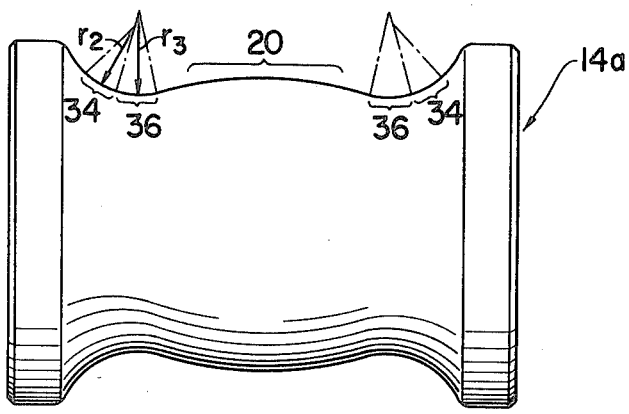
FIG. 5 is a side elevation of an alternative form of the bottom breakdown roll in accordance with the invention.
Figure 6A:
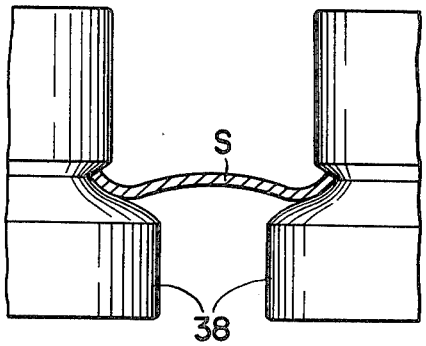
FIGS. 6A, 6B, 6C and 6D are a series of fragmentary side elevations, partly in section, showing several sets of shaping rolls to be placed immediately after the improved breakdown forming roll pair of the invention for bending the skelp into a tubular shape.
Figure 6B:
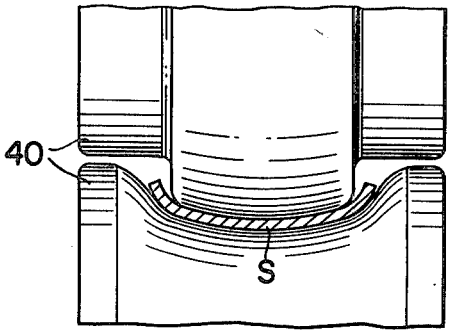
Figure 6C:
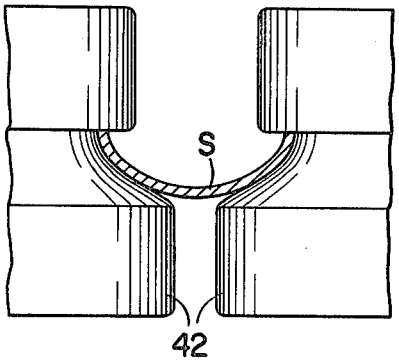
Figure 6D:
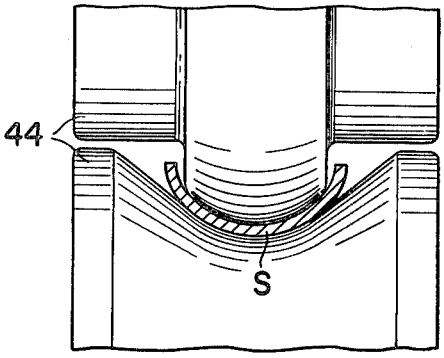

FIG. 5 is an illustration of a bottom breakdown roll 14*a* of slightly modified design. The modification resides in the subdivision of each concave end portion of the bottom roll 14*a* into two segments 34 and 36 arched with different radii $r_2$ and $r_3$. The radius $r_2$ of arc of the outer segment 34 is less than that of the inner segment 36. Alternatively each concave end portion of the bottom roll 14*a* may be subdivided into three or more such segments arched with different radii. In the latter case, the arc radii of each series of segments may be made progressively smaller from the inmost segment toward the outmost one. The modified bottom roll 14*a* is identical in the other respects with the roll 14.

The subdivision of each concave end portion of the bottom breakdown roll 14*a* into at least two segments 34 and 36, as above, offers the advantage of controlling the curling of the skelp edge portions in accordance with the expected degree of its springback. The teachings of FIG. 5 will be particularly useful in curling the edges of a strip of stainless steel, spring steel, titanium steel, or like material having a high degree of springback.

Illustrated in FIGS. 6A through 6D by way of reference are four successive pairs of shaping rolls to be placed immediately after the improved pair of breakdown rolls 14 and 16 of this invention in processing the skelp S into a welded tube. After having its opposite longitudinal edge portions curled by the improved pair of breakdown rolls 14 and 16 as above, the skelp S passes between a pair of side rolls 38 pictured in FIG. 6A. These side rolls 38 act principally as guides, even though they impart some slight transverse stress to the skelps, so that its cross sectional shape remains nearly unchanged. A succeeding pair of top and bottom rolls 40 shown in FIG. 6B acts only on the center portion of the skelp S, bringing it into an approximately arcuate shape. The skelp S acquires a nearly semicircular shape as it subsequently passes between another pair of side rolls 42 of FIG. 6C. Then a pair of top and bottom rolls 44 of FIG. 6D shapes the skelp S into an arc of a smaller radius by acting on its center portion only. Thereafter, the skelps can be processed into a seam-welded tube by any apparatus and through the procedure, well known to those skilled in the art.

A variety of modifications or changes in the details of the improved breakdown rolls of this invention will readily occur to the specialists to conform to specific requirements or considerations in the manufacture of seam-welded tubes of one type or another. It is therefore understood that the illustrated embodiments are illustrative only and not to be taken as a definition of the scope of the invention.

What is claimed is:

1. In a rolling mill for the manufacture of a welded metal tube, including means for curling opposite edge portions of a skelp in an initial step, and means for forming the curled skelp in the shape of a tube, wherein said curling means has, as an improvement, means for forming the skelp so that the midportion of the skelp in its lateral direction is convex and opposite sides of the midportion are concave, said forming means includes a breakdown forming roll set for curling the skelp, comprising:

a first roll having a convex midportion and a pair of concave end portions on opposite sides of the midportion, and a second roll shaped in complementary relation to the first roll and arranged with its rotational axis laid parallel to the rotational axis of the first roll to define a path for the skelp therebetween, wherein the first roll further includes a pair of straight border portions, each interposed between its convex midportion and one of its concave end portions and each inclined at an acute angle in relation to the rotational axis of the first roll, wherein the second roll further includes a pair of straight border portions, each interposed between its concave midportion and one of its convex end portions and each inclined at an acute angle in relation to the rotational axis of the second roll, wherein the convex midportion of the first roll is arched through an angle ranging from about 16° to about 40°, wherein the surface length of the convex midportion of the first roll is from about 38% to about 52% of the length of a working surface of the first roll, wherein the combined surface length of the concave end portions of the first roll is from about 40% to about 45% of the length of the working surface of the first roll, wherein the combined surface length of the straight border portions of the first roll is from about 8% to about 17% of the length of the working surface of the first roll, all as measured in a direction parallel to the axis of the first roll, wherein each concave end portion of the first roll is subdivided into at least two segments arched with different radii, the radius of arc of the segment closer to the axial end of the first roll being less than the radius of the arc of the other segment, whereby the rise of the end portions and bulging of the midportions are minimized so that the possibility of springback and the development of wavy edges are eliminated.

2. In a rolling mill for the manufacture of a welded metal tube, including means for curling opposite edge portions of a skelp in an initial step, and means for forming the curled skelp in the shape of a tube, wherein said curling means has, as an improvement, means for forming the skelp so that the midportion of the skelp in its lateral direction is convex and opposite sides of the midportion are concave, said forming means includes a breakdown forming roll set for curling the skelp, comprising:

a first roll having a convex midportion and a pair of concave end portions on opposite sides of the midportion, and a second roll shaped in complementary relation to the first roll and arranged with its rotational axis laid parallel to the rotational axis of the first roll to define a path for the skelp therebetween, wherein the first roll further includes a pair of straight border portions, each interposed between its convex midportion and one of its concave end portions and each inclined at an acute angle in relation to the rotational axis of the first roll, wherein the second roll further includes a pair of straight border portions, each interposed between its concave midportion and one of its convex end portions and each inclined at an acute angle in relation to the rotational axis of the second roll, wherein the second roll has a pair of straight border portions corresponding to the straiqht border portions of the first roll, wherein the space between each opposed pair of border portions of the first and second rolls gradually increases toward the midportions of the rolls, wherein the angle between each opposed pair of straight border portions of the first and second rolls is from about 0.2° to about 3.0°, wherein each concave end portion of the first roll is subdivided into at least two segments arched with different radii, the radius of the arc of the segment closer to the axial end of the first roll being less than the radius of arc of the other segment, whereby the rise of the end portions and bulging of the midportions are minimized so that the possibility of springback and the development of wavy edqes are eliminated.

* * * * *